US007784198B2

(12) United States Patent
Roudebush

(10) Patent No.: US 7,784,198 B2
(45) Date of Patent: Aug. 31, 2010

(54) ARTICLE OF FOOTWEAR

(76) Inventor: Jacquelyn J. Roudebush, P.O. Box 172, Alexandria, OH (US) 43001

( * ) Notice: Subject to any disclaimer, the term of this patent is extended or adjusted under 35 U.S.C. 154(b) by 821 days.

(21) Appl. No.: 11/527,191

(22) Filed: Sep. 26, 2006

(65) Prior Publication Data

US 2007/0074428 A1 Apr. 5, 2007

Related U.S. Application Data

(60) Provisional application No. 60/722,906, filed on Sep. 30, 2005.

(51) Int. Cl.
*A43B 3/30* (2006.01)
*A43C 11/14* (2006.01)

(52) U.S. Cl. ..... 36/112; 36/90; 36/50.1; 36/9 R

(58) Field of Classification Search ..... 36/112, 36/90, 50.1, 58.5, 9 R
See application file for complete search history.

(56) References Cited

U.S. PATENT DOCUMENTS 2,147,197 A * 2/1939 Glidden ..... 36/9 R
4,649,939 A * 3/1987 Curtis ..... 36/89
5,469,644 A * 11/1995 Vidler ..... 36/127

* cited by examiner

*Primary Examiner*—Ted Kavanaugh
(74) *Attorney, Agent, or Firm*—Fraser Clemens Martin & Miller LLC; J. Douglas Miller

(57) ABSTRACT

An article of footwear is disclosed which has a sock-like fabric body that may be readily applied to the feet of an infant, wherein the article is adaptable to a variety of different sized feet.

3 Claims, 1 Drawing Sheet

ARTICLE OF FOOTWEAR

CROSS-REFERENCE TO RELATED APPLICATION

This application claims the benefit of provisional patent application No. 60/722,906 filed Sep. 30, 2005.

FIELD OF THE INVENTION

The present invention relates to an article of footwear and more particularly to an article of footwear for an infant.

BACKGROUND OF THE INVENTION

There are many articles of footwear for infants, for example, which are designed to encompass an infant's foot for purposes of warmth, support, and function as an integral part of a particular attire. Most of such footwear is miniaturized adult shoes having a sole, an upper portion for enclosing wearer's foot, and means for tightening the same on the wearer's foot. The tightening means generally includes shoe laces and a series of cooperating eyelets formed in the upper portion for receiving shoe laces.

It would be desirable to produce an article of footwear that may be readily applied to the feet of an infant, is difficult for the infant to kick off, is adaptable to a variety of different sized feet to grow with the infant, and is easily cleanable.

SUMMARY OF THE INVENTION

Consistent and consonant with the present invention, an article of footwear that may be readily applied to the feet of an infant, is difficult for the infant to kick off, is adaptable to a variety of different sized feet to grow with the infant, and is easily cleanable, has surprisingly been discovered.

In one embodiment, the article of footwear comprises a fabric main body having a foot section, a heel section, and a bottom section; a first decorative element disposed on a first side of the main body; a second decorative element disposed on a second side of the main body; a first strap disposed between the first decorative element and the second decorative element adjacent the foot section of the main body; a first fastener disposed on the first strap to cooperate with the first decorative element and the second decorative element to tighten the foot section of the main body on a wearer's foot; a second strap disposed between the first decorative element and the second decorative element adjacent the heel section of the main body; a second fastener disposed on the second strap to cooperate with the first decorative element and the second decorative element to tighten the heel section of the main body on the wearer's foot; and a plurality of non-skid grip portions disposed on the bottom section of the main body.

In another embodiment, the article of footwear comprises a fabric main body having a foot section, a heel section, and a bottom portion; a decorative element disposed on the main body and extending from a first side of the main body, around a front of the main body, to a second side of the main body; a first fastener disposed the first side and the second side of the main body and connecting a first end and a second end of the decorative element to tighten the foot section of the main body on a wearer's foot; a strap disposed between the first end and the second end around the heel section of the main body; a second fastener disposed on the strap to cooperate with the first end and the second end of the decorative element to tighten the heel section of the main body on the wearer's foot; and a plurality of non-skid grip portions disposed on the bottom portion of the main body.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
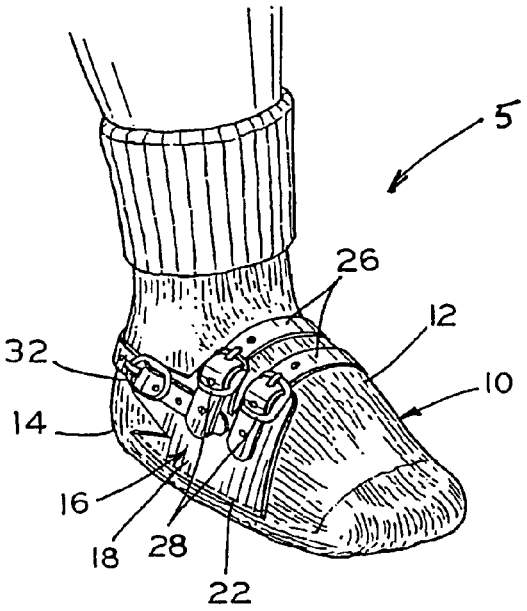
FIG. 1 is a perspective view of an article of footwear according to an embodiment of the invention.

FIG. 1 shows an article of footwear 5 according to an embodiment of the invention. The footwear 5 shown includes a sock-like fabric body 10. The body 10 may be formed of any conventional materials such as, for example, cotton, wool, polyester, or blends thereof. The fabric used to fabricate the body 10 may be stretchable and have a memory enabling it to return to its original shape after being worn. Such a physical property permits and facilitates the donning and doffing of the footwear 5. The body 10 further includes a foot encircling and engaging section 12 and an integral heel and ankle encircling and engaging section 14.

Figure 2:
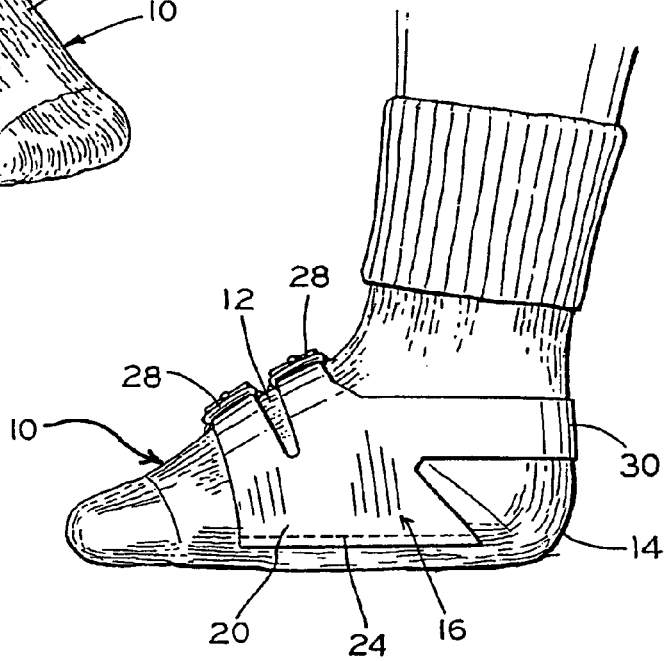
FIG. 2 is a right side elevational view of the footwear illustrated in FIG. 1.

FIGS. 1 and 2 illustrate an overlay 16 affixed to opposing sides of the body 10. The overlay 16 is both decorative and functional. The material used to fabricate the overlay 16 has the inherent properties of being durable, flexible and decorative. By its flexible nature, the material allows the overlay 16 to conform to the shape of the wearer's foot and enhances the formability, thereby facilitating decorative design. Any conventional materials such as, for example, leather, vinyl, or nylon may be employed to form the overlay 16.

The overlay 16 includes a first decorative element 18 affixed to the body 10 and a second decorative element 20 affixed to the opposing side of the body 10. Marginal edges 22 and 24 of the elements 18 and 20, respectively, may be affixed to the body 10 by any conventional means, such as, for example, stitching or gluing. The overlay 16 is affixed to the body 10 along the edge 22 and the edge 24 extending from the foot encircling and engaging section 12 of the body 10 toward the heel and ankle engaging section 14 of the body 10.

The overlay 16 is provided with straps 26 extending over the foot of the wearer. The straps 26 may be used functionally to tighten the overlay 16 and the associated foot encircling and engaging section 12 on the wearer's foot, as well as add to the appearance and distinctiveness of the footwear 5. The material used to fabricate the straps 26 has the inherent properties of being durable, flexible and decorative. By its flexible nature, the material allows the straps 26 to conform to the shape of the wearer's foot and enhances the formability, thereby facilitating decorative design, as well as militates against being easily removed by an infant wearer during kicking, etc. Although two straps 26 are shown, more or fewer straps 26 can be used as desired. Any conventional materials such as, for example, leather, vinyl, or nylon may form the straps 26.

The straps 26 are provided with a fastener 28. The fastener 28 can be any conventional fastener such as a buckle, laces, hook and loop tape, ribbon, or a combination thereof, for example. In one embodiment, hook and loop tape can be used to join the straps 26 to the element 18 of the overlay 16 with non-functional decorative buckles disposed on the straps 26. The position of the fastener 28 may be such as to imitate a right foot and left foot, or a neutral or interchangeable arrangement.

Figure 3:
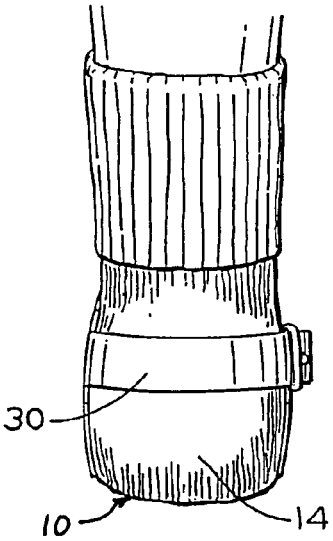
FIG. 3 is a rear elevational view of the footwear illustrated in FIGS. 1 and 2.

The overlay 16 is provided with a second strap 30 which extends around the ankle of the wearer, as shown in FIG. 3. The strap 30 may be used functionally to tighten and hold in place the overlay 16 and the associated foot encircling and engaging section 12 on the wearer's foot. The material used to fabricate the strap 30 has the inherent properties of being durable, flexible and decorative. By its flexible nature, the material allows the strap 30 to conform to the shape of the wearer's foot and enhances the formability, thereby facilitating decorative design, as well as militates against being easily removed by an infant wearer during kicking, etc. Although one strap 30 is shown, additional straps 30 may be provided as desired. Any conventional materials such as, for example, leather, vinyl, or nylon may form the strap 30.

The strap 30 is provided with a fastener 32. The fastener 32 can be any conventional fastener such as a buckle, laces, hook and loop tape, or a combination thereof, for example. The second strap 30 may be a contiguous part of the overlay 16 or separate from and fastened to the overlay 16 by any conventional means such as, for example, stitching or gluing.

Figure 4:
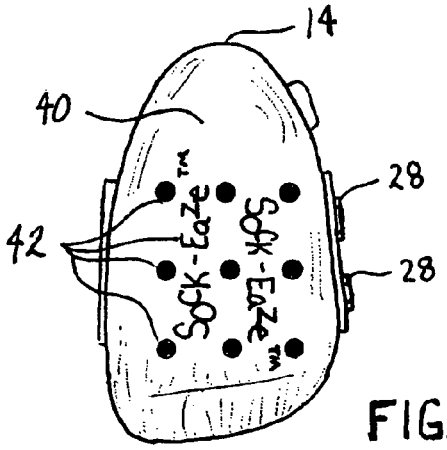
FIG. 4 is a bottom view of the footwear illustrated in FIGS. 1, 2, and 3.

FIG. 4 shows a bottom portion 40 of the body 10. A plurality of non-skid grip portions 42 is disposed on the bottom portion 40. Although the grip portions 42 shown are formed by circular shapes and word markings, it is understood that others shapes and patterns can be used as desired. Any conventional non-skid material can be used to form the grip portions 42 such as rubber, plastic, or adhesive based materials. When the footwear 5 is used for an infant, it may be desirable to use a non-skid material having non-toxic properties.

The grip portions 42 function to militate against a slipping of the foot of the wearer on a supporting surface (not shown) such as a floor. More or fewer grip portions 42 can be used as desired.

While the illustrated embodiment of the invention shows a sandal-type overlay 16, many other decorative overlays could be employed without departing from the spirit of the invention. The overlay 16 is typically formed from a sheet material which may be readily formed into the desired shape and affixed to the body 10 by stitching, gluing, or other suitable manner.

The footwear 5 is also provided with a mesh bag (not shown). The mesh bag is used for display purposes upon purchase of the footwear 5. However, the mesh bag also facilitates machine washing and drying of the footwear 5 while militating against loss of the footwear 5 or separation of one of the pair.

Thus, the footwear 5 may be readily applied to the feet of an infant. The footwear 5 is also difficult for the infant to kick off. Additionally, the footwear 5 is adaptable to a variety of different sized feet which allows the footwear 5 to be used with the infant as the infant grows. The footwear 5 is also easily cleanable.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An article of footwear for an infant comprising:

a fabric main body having a foot section, a heel section, and a bottom portion, wherein said main body is fabricated from a stretchable material;

an overlay including a first decorative element disposed on a first side of said main body, the first decorative element having a first marginal edge affixed to the foot section on the first side of said main body, the first marginal edge spaced apart from the bottom portion of said main body, and a second decorative element disposed on a second side of said main body, the second decorative element having a second marginal edge affixed to the foot section on the second side of said main body, the second marginal edge spaced apart from the bottom portion of said main body;

a first strap disposed between the first decorative element and the second decorative element adjacent the foot section of said main body;

a first fastener disposed on said first strap to cooperate with the first decorative element and the second decorative element to tighten the foot section of said main body on the infant's foot;

a second strap disposed between the first decorative element and the second decorative element adjacent the heel section of said main body;

a second fastener disposed on said second strap to cooperate with the first decorative element and the second decorative element to tighten the heel section of said main body on the infant's foot; and a plurality of non-skid grip portions disposed on the bottom portion of said main body, wherein upon a tightening of said overlay by fastening the first strap between the first decorative element and the second decorative element with said first fastener, the first decorative element and the second decorative element cause the stretchable material of the foot section and the bottom section between the first marginal edge and the second marginal edge to stretch across a sole of the infant's foot, thereby militating against the infant kicking off the footwear.

2. The article of claim 1, wherein said non-skid grip portions are arranged in a plurality of rows and a plurality of columns on the bottom portion of said main body.

3. The article of claim 1, wherein said fabric main body is unitary and one-piece.

* * * * *